US008690428B2

(12) United States Patent
Kruse et al.

(10) Patent No.: US 8,690,428 B2
(45) Date of Patent: Apr. 8, 2014

(54) PLASTIC BAG WITH POUR SPOUT AND SLIDE CLOSURE

(75) Inventors: Alfons Kruse, Dinklage (DE); Jens Koesters, Wallenhorst (DE)

(73) Assignee: Mondi Halle GmbH, Halle (DE)

( * ) Notice: Subject to any disclaimer, the term of this patent is extended or adjusted under 35 U.S.C. 154(b) by 313 days.

(21) Appl. No.: 12/616,867

(22) Filed: Nov. 12, 2009

(65) Prior Publication Data

US 2010/0142858 A1 Jun. 10, 2010

(30) Foreign Application Priority Data

Nov. 14, 2008 (EP) ..... 08019910

(51) Int. Cl.

| | |
|---|---|
| ***B65D 33/14*** | (2006.01) |
| ***B65D 33/10*** | (2006.01) |
| ***B65D 33/16*** | (2006.01) |
| ***B65D 30/20*** | (2006.01) |

(52) U.S. Cl.

USPC ..... 383/5; 383/10; 383/61.2; 383/64; 383/120; 383/906

(58) Field of Classification Search

USPC ..... 383/5, 64, 61.2, 120, 906, 109

See application file for complete search history.

(56) References Cited

U.S. PATENT DOCUMENTS

| | | | | |
|---|---|---|---|---|
| 1,718,276 | A * | 6/1929 | Child | 383/97 |
| 2,358,653 | A | 9/1944 | Mock | 383/64 |
| 2,929,123 | A | 3/1960 | Schneideman | 24/399 |
| 6,186,663 | B1 * | 2/2001 | Ausnit | 383/63 |
| 6,193,416 | B1 * | 2/2001 | Kawamata et al. | 383/104 |
| 6,325,543 | B1 | 12/2001 | Ausnit | 383/210.1 |
| 6,464,394 | B1 | 10/2002 | Galomb | 383/10 |
| 6,533,456 | B1 * | 3/2003 | Buchman | 383/63 |
| 6,572,267 | B1 * | 6/2003 | Forman | 383/61.2 |
| 6,805,485 | B2 * | 10/2004 | Hogan et al. | 383/64 |
| 7,144,159 | B2 * | 12/2006 | Piotrowski et al. | 383/64 |
| 7,192,191 | B2 * | 3/2007 | Wedi et al. | 383/64 |
| 7,204,641 | B2 * | 4/2007 | Stolmeier | 383/64 |
| 7,506,487 | B2 | 3/2009 | Eads et al. | 53/412 |
| 2003/0100424 | A1 * | 5/2003 | Barmore et al. | 493/394 |
| 2007/0230834 | A1 * | 10/2007 | Schneider | 383/64 |
| 2008/0008406 | A1 * | 1/2008 | Russell et al. | 383/63 |
| 2011/0091140 | A1 * | 4/2011 | Wedi et al. | 383/120 |

FOREIGN PATENT DOCUMENTS

| | | | | |
|---|---|---|---|---|
| EP | 1442992 | | 8/2004 | |
| EP | 1873081 | A1 * | 1/2008 | B65D 75/58 |
| JP | 08026302 | A * | 1/1996 | B65D 33/36 |
| JP | 2001031119 | A * | 2/2001 | B65D 33/36 |
| JP | 2005153974 | A * | 6/2005 | B65D 33/01 |
| WO | WO-2004026704 | | 4/2004 | |
| WO | WO 2007147568 | A1 * | 12/2007 | B65D 31/10 |

* cited by examiner

*Primary Examiner* — Jes F Pascua

(74) *Attorney, Agent, or Firm* — Andrew Wilford

(57) ABSTRACT

A bag has two juxtaposed face panels of plastic film and each having two parallel side edges and top and bottom edges. A gusset extends between one of the side edges of one of the panels and the juxtaposed side edge of the other of the panels. The gusset is movable between a folded-in condition lying mainly between the panels and an extended condition projecting laterally past the panels and forming a spout generally at the top edges. A slide fastener at the top edges has two profile strips that can be locked to each other and that each have an attachment flap, and a slider shiftable along the profile strips in a closing direction to close the strips together and in an opposite opening direction to separate the strips. Joints secure the attachment flaps directly to inner faces of the respective face panels at the respective upper edges.

7 Claims, 8 Drawing Sheets

PLASTIC BAG WITH POUR SPOUT AND SLIDE CLOSURE

FIELD OF THE INVENTION

The present invention relates to a plastic packaging bag for holding pourable material. More particularly this invention concerns such a bag having a pour spout and a slide closure.

BACKGROUND OF THE INVENTION

A typical packaging plastic bag has two face panels formed from a plastic film and juxtaposed with each other, a gusset extending from an upper end of the bag across at least part of the bag side and connecting the juxtaposed face panels at that location, and a slide fastener extending transversely at the upper end and comprising a slider, two profile strips that can be locked to each other and that are gripped by the slider, and two attachment flaps connected thereto and securing the slide fastener to the bag film inside the bag, movement of the slider limited by a first end of the slide fastener along the profile strips in a first direction connecting and movement limited by the second end of the slide fastener in a second direction separating the profile strips, whereby the gusset forms a spout with an opened slide fastener in the extended position, and the gusset is covered by the connected profile strips at the top at its upper end forming the spout in a closed position of the slide fastener, and, if the gusset is folded-in or if the slide fastener extends at the first end beyond the face panels and is arranged on the gusset forming the spout, this spout is fixed in a open position by the slide fastener.

A bag having the features described is known from EP 1 442 992 [U.S. Pat. No. 7,144,159]. According to the known embodiment the attachment flaps of the slide fastener are attached to inner faces of the bag by welding. The slide fastener may therefore also be attached without any problems by welding to bags having an outside layer, such as from polyester, that is not weldable or that is difficult to weld. Furthermore, the appearance of the bag is not adversely affected by the arrangement of the slide fastener. The known bag is a side-gusset bag having two gussets opposite each other and connecting the face panels, the gussets extending the entire height of the bag. The slide fastener extends across the entire width of the face panels, and is therefore also connected to the two gussets. The slide fastener projects over the upper edge of the bag film at its profile strips that can lock into each other such that the one spout-forming gusset is overlapped, e.g. closed by the locked together profile strips in the folded-in position and with the slide fastener closed.

While one of the attachment flaps extends completely along one of the face panels, the other attachment flap is attached both on the opposite face panel and to the inextensible gusset. The transition present between these areas forms a step, which is at high risk of leakage due to the overlapping layers and particularly due to the transition from two layers, e.g. the two face panels, to four layers, e.g. the two face panels with the gusset enfolded therein. Furthermore, unevenness may occur in the face panels at the transition such that the appearance of the bag is adversely affected.

OBJECTS OF THE INVENTION

It is therefore an object of the present invention to provide an improved plastic bag with pour spout and slide closure.

Another object is the provision of such an improved plastic bag with pour spout and slide closure that overcomes the above-given disadvantages, in particular that has a high-quality appearance and a secure tamper-indicating closure before initial opening.

SUMMARY OF THE INVENTION

A bag has according to the invention two juxtaposed face panels of plastic film and each having two generally parallel side edges and top and bottom edges bridging the side edges. A gusset extends between one of the side edges of one of the panels and the juxtaposed side edge of the other of the panels. The gusset is movable between a folded-in condition lying mainly between the panels and an extended condition projecting laterally past the panels and forming a spout generally at the top edges. A slide fastener at the top edges has two profile strips that can be locked to each other and that each have an attachment flap, and a slider shiftable along the profile strips in a closing direction to close the strips together and in an opposite opening direction to separate the strips. Joints secure the attachment flaps directly to inner faces of the respective face panels at the respective upper edges.

In other words, according to the invention the attachment flaps directly abut the face panels and are connected to the face panels at the second end of the slide fastener. The attachment flaps are each attached to one of the face panels at the second end of the slide fastener. The profile strips are mounted above the edge of the face panels such that the slider may be moved freely, and the slider acts directly on the profile strips. In this manner continuous transitions may be avoided along the attachment flaps such that in addition to an improvement of the leak tightness and of the optical appearance, easy actuation of the slider may also be ensured, even with short attachment flaps.

The profile strips may be tongue and groove formations, one of the strips being the female part having a groove and the other strip being the male element with a tongue. Slider closures, e.g. slide fasteners having a slider, are characterized by very simple handling and ensure a comparatively safe and tight closure. While the elements should be manually easy to lock together and separate in a simple zipper closure, thus limiting the strength of the slide fastener, very tight latches may also be created without any problems by actuation of the slider. In this regard it is of particular advantage that the slider may also spread or deform the tongue and groove formations in order to insert the tongue into the groove.

According to a first embodiment of the invention the bag has no further gusset in addition to the extensible spout-forming gusset. The only gusset according to such an embodiment may be formed either between the face panels by folds from the bag film or by a separate film section. According to a preferred further improvement the invention provides that the gusset is formed by a separate piece of film and extends only across part of the upper edge of the bag side. In this manner it is possible to provide a large spout in tubular bags to facilitate removal of the contents. With such an embodiment the additional gusset does not increase the fill capacity, but instead merely facilitates handling. For this purpose the bag may have a standup base, such an embodiment being called a standup pouch.

According to an alternative embodiment of the invention the bag is a side-gusset bag and has a second inextensible gusset opposite the spout-forming gusset. In this regard it is also possible to insert the gussets as separate pieces of film between the face panels during manufacture of the bag or preferably to form the side-gusset bag having the face panels and its gussets by folds from the bag film. However, with the embodiment as a side-gusset bag additional measures are required in order to attach the attachment flaps directly to the face panels at the second end of the slide fastener.

According to the invention the inextensible gusset ends at a spacing from the upper end and is covered at its upper edge for ensuring a leak-tight closure. For this purpose a separate film sheet is provided that closes the inextensible gusset at its upper edge inside the bag and connects it to one of the face panels. In order to form such a bag, the invention may equip the bag film with a window-shaped cutout during the production that limits the upper end of the inextensible gusset that is formed at a later time. The separate film sheet is then placed on the bag film and welded using sections of the film web that adjoin the window-shaped cutout either directly or at a small spacing and form the upper film layer of the gusset on the gusset formed at a later time, the film sheet projecting into the window-shaped cutout and being broader than the gusset formed later. Subsequently, the gussets are formed in a folding station by folding the bag film. Finally, welding is done to close the inextensible gusset at its upper end with the film sheet. The mounting of the slide fastener is usually carried out before folding the material web, the slide fastener also extending across part of the width of a face panel or also across the entire width of the face panels due to the offset inextensible gusset.

Generally, a weld may be provided at the preferably offset inextensible gusset as described above and that extends from the respective side edge diagonally toward the top and along the upper end of the bag at the face panels, and connects the face panels to the inextensible gusset or to each other along its length. The diagonally extending weld preferably extends directly up to the slide fastener. Due to the embodiment described the invention ensures that the contents in the bag may not accumulate at the offset gusset. In addition, the diagonally extending weld also serves to guide the contents toward the extendable gusset such that the bag is very easy to handle and particularly easy to empty. A longitudinal weld that extends diagonally laterally across from the extensible spout-forming gusset is generally also conceivable in an embodiment having only a single gusset, as described above.

In an embodiment having a weld extending diagonally toward the top, the slide fastener extends only across part of the width of the face panels. In addition or as an alternative to the weld extending diagonally toward the top the invention may provide for this purpose that in a side-gusset bag the upper end is cut off above the inextensible gusset. Furthermore, it is possible to provide a hand hole at the upper end opposite the spout-forming gusset. In a side-gusset bag it is therefore not necessary to offset the inextensible gusset, rather the inextensible gusset preferably extends up to the upper edge of the bag, the hand hole being reinforced by the material of the gusset in such an embodiment. In order to ensure sufficient tightness also at the hand hole the surrounding areas may be welded together all around it.

The first end of the slide fastener extends at the extensible spout-forming gusset preferably up to directly onto it. In order to empty contents, the gusset is then pulled out to enlarge the pour opening. In order to reclose it the spout-forming gusset is then folded-in between the face panels with the slider crossing over the area of the gusset when moving in the first direction and the gusset folded-in between the face panels being covered at its upper end by the profile strips as they lock together in the closed position.

An alternative embodiment provides that the slide fastener extends beyond the face panels at the first end, and is mounted on a spout-forming gusset such that it is fixed in a inextensible position by the slide fastener. According to this embodiment the spout-forming gusset always remains extended, and the length of the slide fastener is longer than the width of the face panels. Such an embodiment is advantageous especially if optionally very large or small amounts are to be emptied from the bag. When removing small amounts the always extended spout enables very precise dosing. However, a quick, complete emptying is easily possible with a completely opened slide fastener, since practically the entire upper end including the extended gusset forms a dispensing opening.

Due to the slide fastener provided by the invention the contents are protected from falling out of the bag after initial opening, and also from environmental influences to a degree. Usually, however, an air-tight tamper-indicating closure is required before initial opening. This is also advantageous in order to clearly indicate the initial opening to a user such that any possible tampering with the contents may be excluded. In order to obtain a tamper-indicating closure the attachment flaps may be detachably connected to each other. If the spout-forming gusset is initially folded-in between the face panels according to the preferred embodiments described above, such a detachable connection of the attachment flaps is possible only in the part of the slide fastener that is adjacent the gusset. In addition or alternatively, a tamper-indicating closure may also be ensured by a peel-off, e.g. separable, weld or adhesive joint in a particularly advantageous manner. In order to create both permanent heat-sealed joints and separable welds during the production of the bag, local coatings are used that counteract a permanent sealing. Preferably, the attachment flaps are made from different materials on the inside and outside, at least where a seal is provided, a material being used at the sides facing the side walls to form a permanent, fixed seal, and a material is used on the sides of the attachment flaps facing each other, which brings about a peeling seal that can be separated against itself and against the bag film.

Finally, as an alternative or in combination with the above-described characteristics, a piece of film at least partially covering the slide fastener at the upper end may be provided that can be removed for the initial opening of the bag and for exposing the slider. Such an embodiment is characterized in that the slider is also protected from unintentional actuation. In addition, the entire slide fastener is also protected against contamination or other adverse effects.

The film from which the juxtaposed face panels and preferably also the one or more gussets are formed, may be embodied within the scope of the invention as a single-layer film without any limitations in the manner of a multilayer, coextruded or multilayer laminated film. A laminated bond with a welded core layer and an outer layer that cannot be welded, or which at least has a higher welding temperature than the core layer, is particularly preferred. Within the scope of such an embodiment the bag may be formed by folds and seals without the outer layer forming the outer surface being adversely influenced with regard to its structure or appearance. For example, a laminating bond having a core layer of polyolefin, such as polyethylene, and an outer layer of polyester, such as polyethylene terephthalate, is suitable, the outer layer having an inner-face imprint that has been affixed before bonding to the core layer. Regardless of the actual embodiment of the interior and outer layers, a multilayer film may have intermediate layers that are provided, for example, for improving the barrier effect.

BRIEF DESCRIPTION OF THE DRAWING

The above and other objects, features, and advantages will become more readily apparent from the following flap description, reference being made to the accompanying drawing flap in which.

SPECIFIC DESCRIPTION

Figure 1:
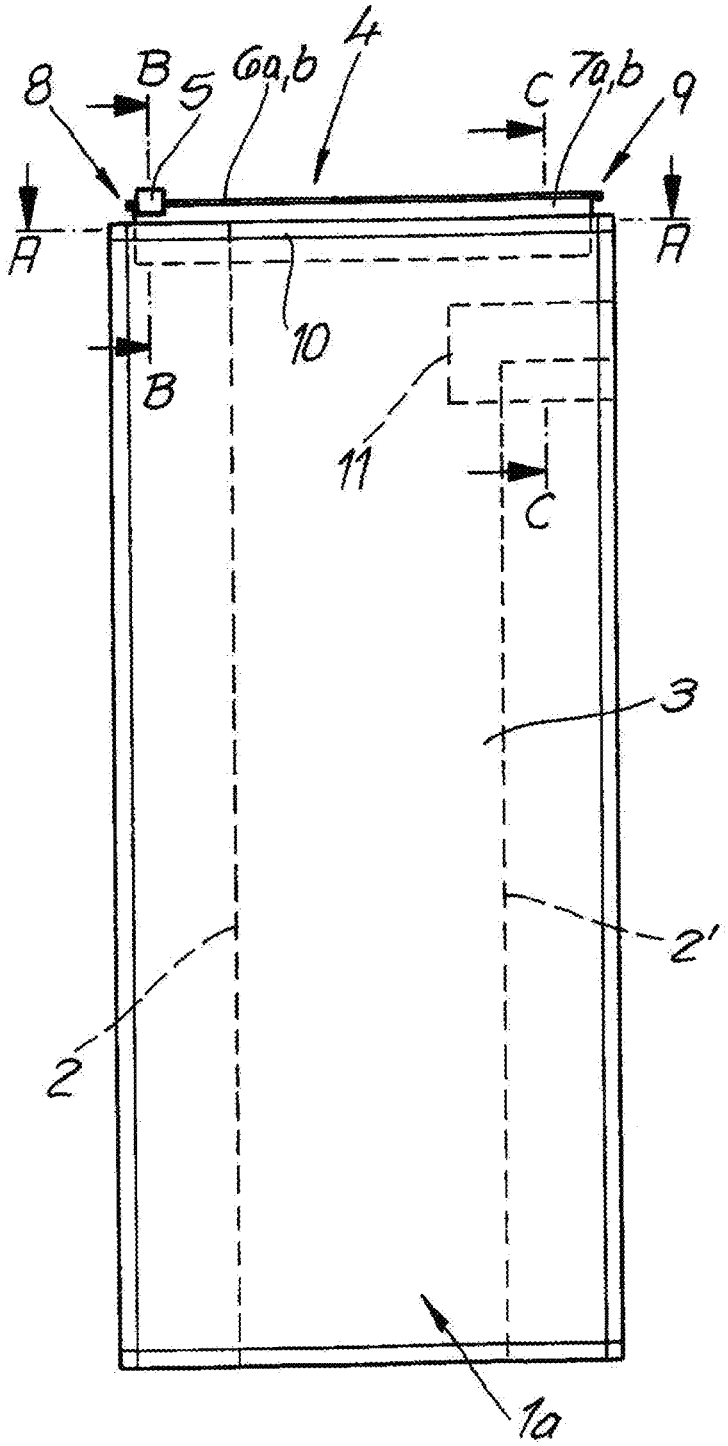
FIG. 1 shows a bag in a front view.

As seen in FIG. 1 a bag according to the invention is formed as a side-gusset bag having two rectangular face panels 1*a* and 1*b* positioned opposite each other, and two gussets 2 and 2' connecting normally vertical side edges of the face panels 1*a* and 1*b*. Without limitation the bag may be formed from individual sections or preferably by folds and seals from a single piece of film 3.

A slide fastener 4 is provided at the horizontal upper end of the bag defined by upper edges of the panels 1*a* and 1*b* and extends across the entire width of the face panels 1*a* and 1*b*. The slide fastener 4 comprises a gripper-type slider 5, two profile strips 6*a* and 6*b* that can be locked to each other by the slider 5 and that carry attachment flaps 7*a* and 7*b* that connect the slide fastener 4 to the bag film 3 on inner surfaces of the bag. FIG. 1 shows the slide fastener 4 in the closed position with the slider 5 at a first end 8 of the slide fastener 4. Here the first end 8 blocks movement of the slider 5 along the profile strips 6*a* and 6*b* in a first closing direction. Opposite movement of the slider 5 in a second opening direction separates the profile strips 6*a* and 6*b* that were initially locked to each other to open the slide fastener 4.

Figure 3:
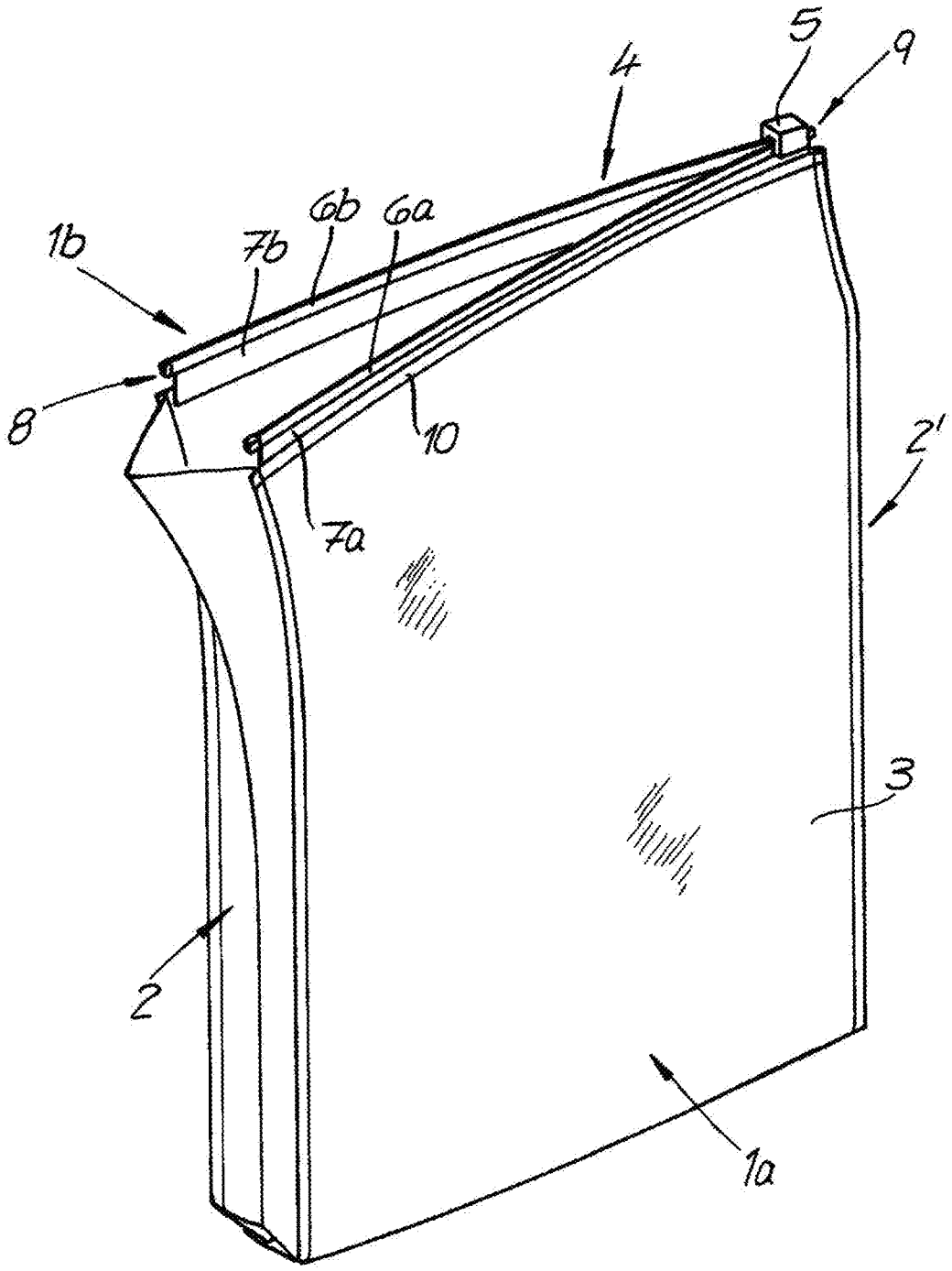
FIG. 3 shows the bag according to FIG. 1, having an opened slide fastener in a perspective view.

In the illustrated closed position of the slide fastener 4, the gusset 2 is closed, e.g. covered, along its upper edge by the connected profile strips 6*a* and 6*b* above it. FIG. 3 shows the film package bag with an opened slide fastener 4 and the slider at a second end 9 of the slide fastener at which the profile strips 6*a* and 6*b* and optionally also the attachment flaps 7*a* and 7*b* are permanently connected to each other, such as by welding. In case of an open slide fastener 4, the gusset 2 at the first end 8 of the slide fastener 4 may be extended to form a spout, thus enabling simple and accurate pouring of the contents from the bag. Extension of the gusset 2 is even possible with a partial opening of the slide fastener 4 such that the size of the dispensing opening may be freely selected.

Figure 2A:
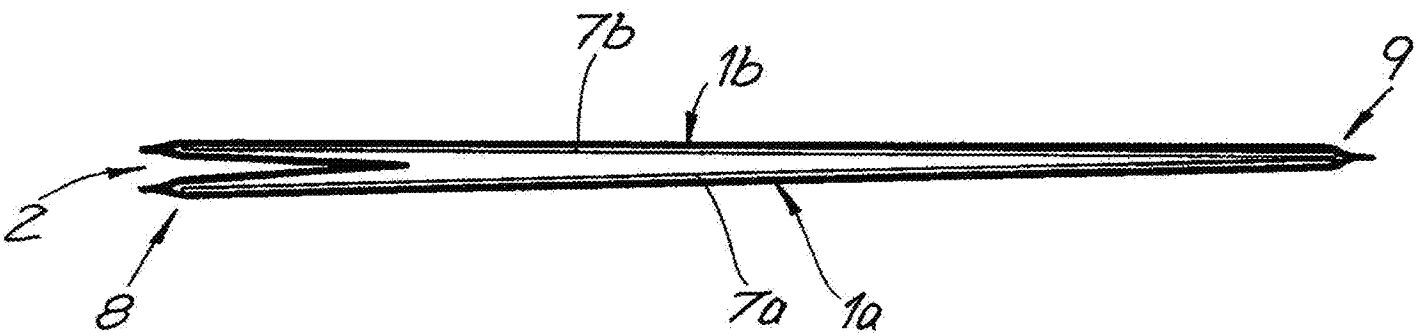
FIG. 2*a* is a section along the line A-A of FIG. 1.

The section of FIG. 2*a* along the line A-A of FIG. 1 shows that the one attachment flap 7*a* is connected to one of the face panels 1*a* along its entire width, and the other attachment flap 7*b* is connected to the other face panel 1*b*, the attachment flaps 7*a* and 7*b* with their profile strips 6*a* and 6*b* extending across the entire width of the respective face panels 1*a* and 1*b*. In particular, the slide fastener 4 reaches all the way to the gusset 2 that is folded-in in a V shape at the first end 8. In the closed position this gusset is therefore closed at the top according to FIG. 2*b* by the locked-together profile strips 6*a* and 6*b*. The profile strips 6*a* and 6*b* have tongue and groove formations in a conventional manner, one of the profile strips 6*a* being a female and formed with a groove and the other profile strip 6*b* being male and having a tongue.

Figure 2B:
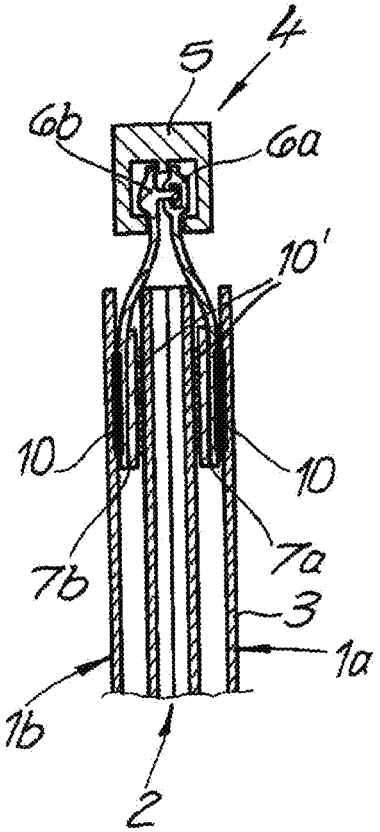
FIG. 2*b* is a section along the line B-B of FIG. 1.
Figure 2C:
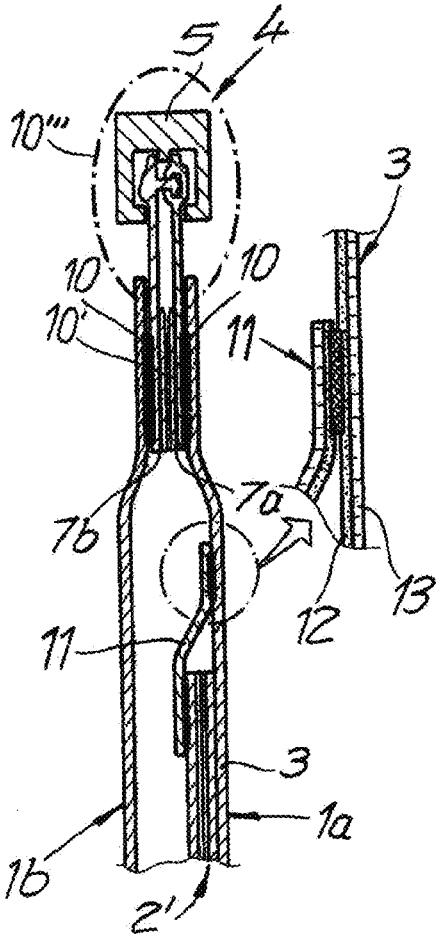
FIG. 2*c* is a section along the line C-C of FIG. 1.

According to FIGS. 2B and 2C the attachment flaps 7*a* and 7*b* are connected to the bag film 3 inside the bag by welding. To this end permanent welds 10 are provided between the bag film 3 and the attachment flaps 7*a* and 7*b*. In order to also form a tamper-indicating closure, the attachment flaps 7*a* and 7*b* can be connected to each other along faces opposite the permanent welds 10 by a separable weld 10' that can be split or are connected to the inextensible gusset 2 before the first opening of the bag. In order to both create permanent welds 10 and peel-off welds 10', sections of the bag film 3 may be coated such that a permanent bonding is prevented where necessary. Furthermore, it is also possible to form the attachment flaps 7*a* and 7*b* from at least two layers that enable formation of a permanent seal on the side against the face panels 1*a* and 1*b* but only a separable peel-off connection on the side opposite the bag film. FIG. 2C also schematically shows at 10''' a tear-off tamper-indicating band on the slide-fastener that is removed for first use of the bag.

A comparative view of FIG. 1 and FIG. 2C shows that the second gusset 2' is made to be a inextensible and is covered underneath the attachment flaps 7*a* and 7*b* by a separate film sheet 11. The film sheet 11 closes the inextensible gusset 2' and fixes it against the face panel 1*a*. With this embodiment, one of the attachment flaps 7*a* and 7*b* does not have to engage the extendable gusset 2' so that the appearance of the bag and the tightness are not adversely affected.

Furthermore, the sectional illustrations of FIGS. 2*b* and 2*c* show that the bag film 3 is formed of several layers, namely an inner layer 12 and an outer layer 13. While the inner layer 12 is comprised of a weldable material, such as polyethylene, the outer layer 13 is preferably not weldable, or at least has a higher melting point. Making the outer layer 13 of, for example, polyethylene terephthalate is advantageous since it has good mechanical properties and a high-quality appearance. The film sheet 11 may also be formed of layers, with at least the layer facing the gusset 2' being weldable. When the opposite layer is not weldable or difficult to weld, the film sheet 11 is not likely to be accidentally fused to the opposite face panel 1*b*.

Figure 4:
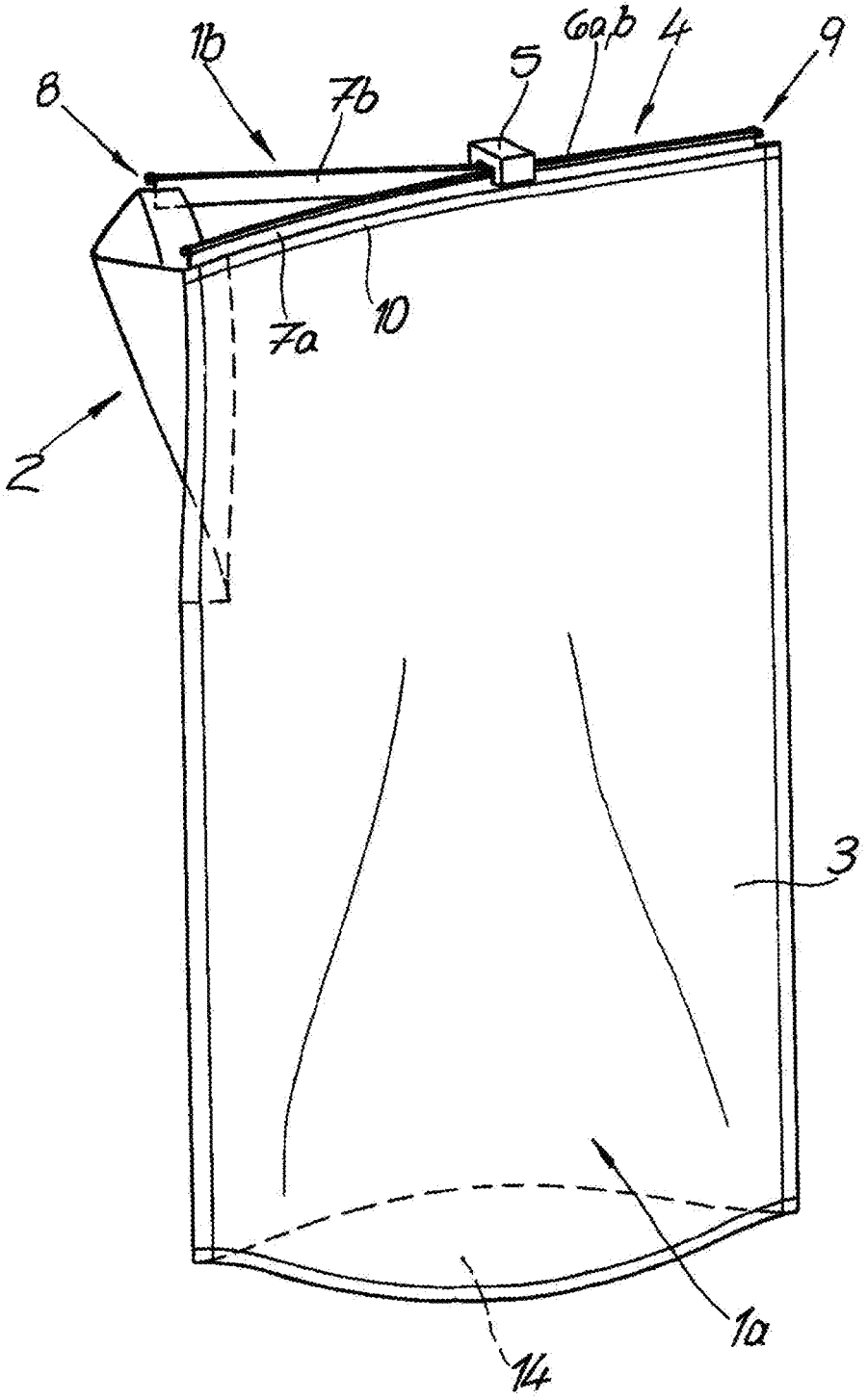
FIG. 4 shows an alternative embodiment of the bag in a view according to FIG. 3.

FIG. 4 shows an alternative embodiment of the bag as a standup bag with a gusset 2 made from a separate piece of film inserted at the first end 8 of the slide fastener 4 and extending only across a portion of the bag end. The face panels 1*a* and 1*b* are connected directly to each other at a lower end of the bag underneath the gusset 2 and at the opposite edge of the bag. A separate piece of film 14 is provided as the standup base of the bag. The gusset 2 inserted at the upper end only serves to enable easier emptying, and particularly for precise dosing, and does not contribute to increasing the fill capacity. Thus the height and depth of the gusset 2 may be selected according to ergonomic considerations regardless of the intended contents.

Since the slide fastener 4 extends across the entire width of the face panels 1*a* and 1*b*, a quick and complete emptying of the bag is also possible. As in the embodiment according to FIGS. 1 to 2*c* described above it may also be provided that the slide fastener 4, based on the extendable gusset 2 forming a spout, extends only across part of the face panels 1*a* and 1*b*, such as approximately up to the center of the face panels 1*a* and 1*b*. Due to the fact that the discharge opening is significantly enlarged because of the extending of the gusset 2, only a comparatively short slide fastener 4 is necessary according to the invention for good handling, particularly if no uncontrolled, complete emptying of the bag needs to occur. Therefore, a precise controlling of the contents is usually necessary when pouring the contents out of the bag such that a complete opening on the top is often not required or desired.

Figure 5:
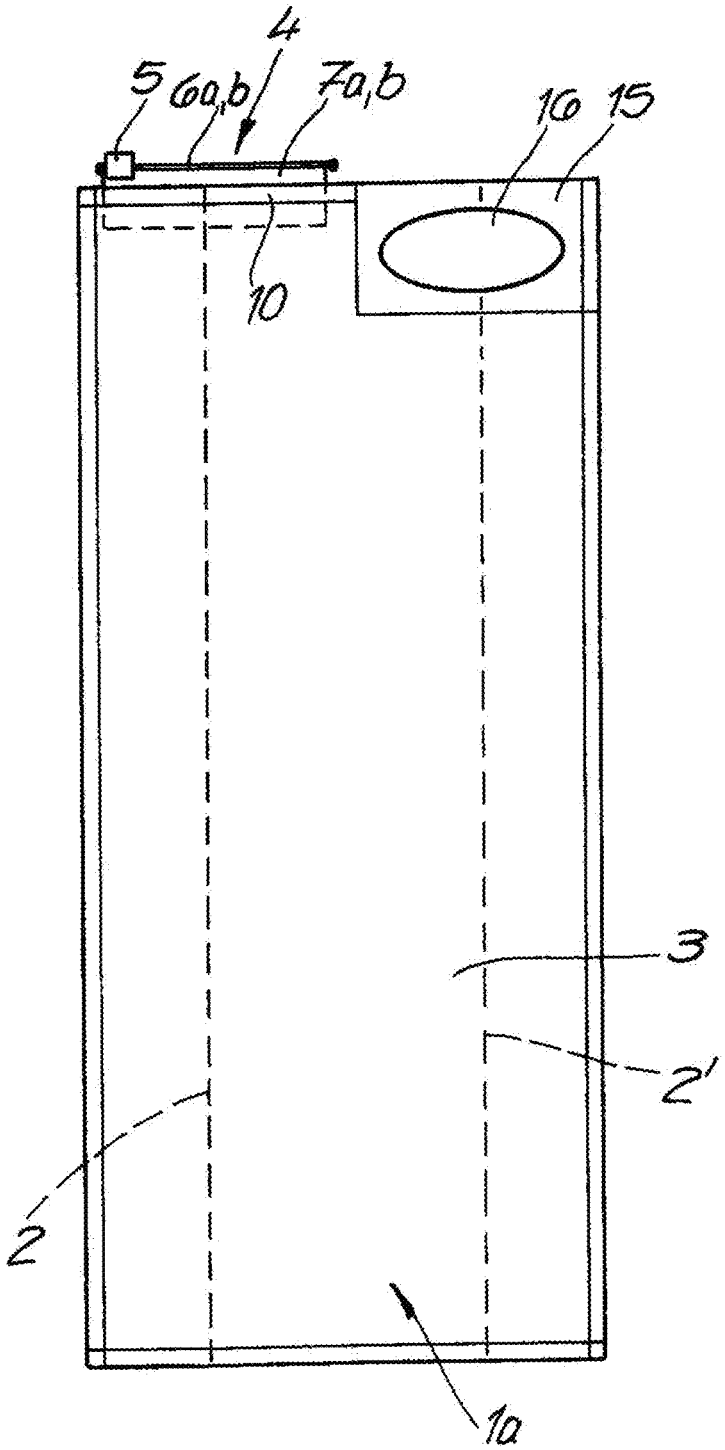
FIGS. 5 to 7 show further alternative embodiments of the bag in a top view according to FIG. 1.
Figure 6:
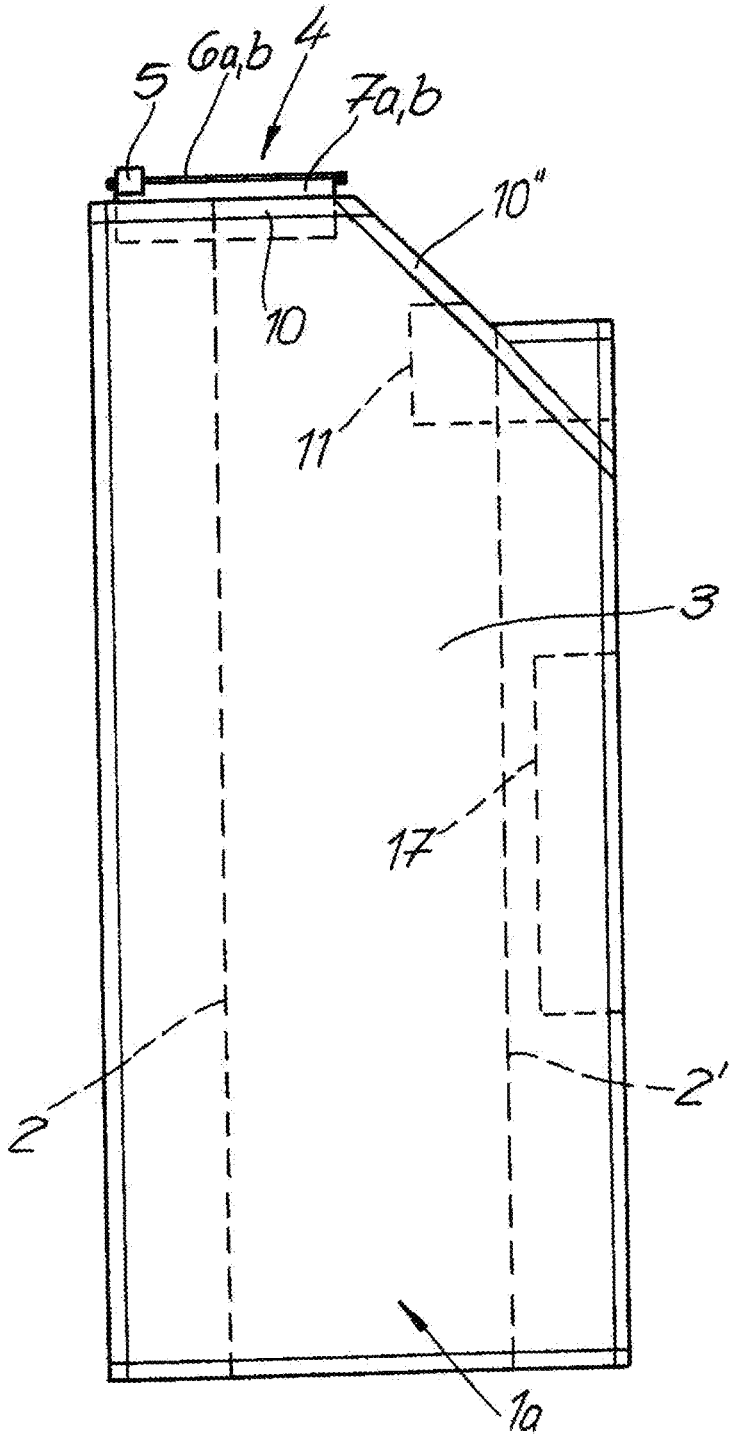

Accordingly, FIGS. 5 and 6 illustrate embodiments of side-gusset bags where the slide fastener 4 extends only across part of the width of the face panels 1*a* and 1*b*. According to FIG. 5 the inextensible gusset 2' extends up to the upper end of the bag. At the upper end of the gusset, however, a flat seal 15 is provided for the face panels 1*a* and 1*b* with a gusset 2', or the face panels 1*a* and 1*b* are sealed to each other with a hand hole 16 provided within the flat seal 15.

According to FIG. 6 the inextensible gusset 2' is covered by a separate film sheet 11 as described above. In addition, a weld 10" extending diagonally toward the top is provided on the inextensible gusset 2' extending from the side edge to the top end and connecting the face panels 1*a* and 1*b* to the inextensible gusset 2' or connecting the face panels 1*a* and 1*b* to each other. To this end the diagonal weld 10" transitions into the weld 10 on the top end so that the attachment flaps 7*a* and 7*b* are connected to the face panels 1*a* and 1*b*. Due to the weld 10" extending diagonally toward the top the contents in the bag are guided during emptying toward the discharge opening such that easy and complete emptying is enabled. A weld 10" correspondingly extending diagonally toward the top may advantageously be provided whenever the slide fastener 4 should not extend across the entire width of the face panels 1*a* and 1*b*. As an additional characteristic in the embodiment according to FIG. 6 the upper end is cut off above the inextensible, offset gusset 2'.

As an alternative to the hand hole 16 shown in FIG. 5 handles 17 may generally be provided at the inextensible gusset 2' in an embodiment as a side-gusset bag. The provision of such a handle is indicated in FIG. 6. Regardless of the precise embodiment of the bag, handle strips may also be attached to the face panels 1*a* and 1*b* as an alternative.

Figure 7:
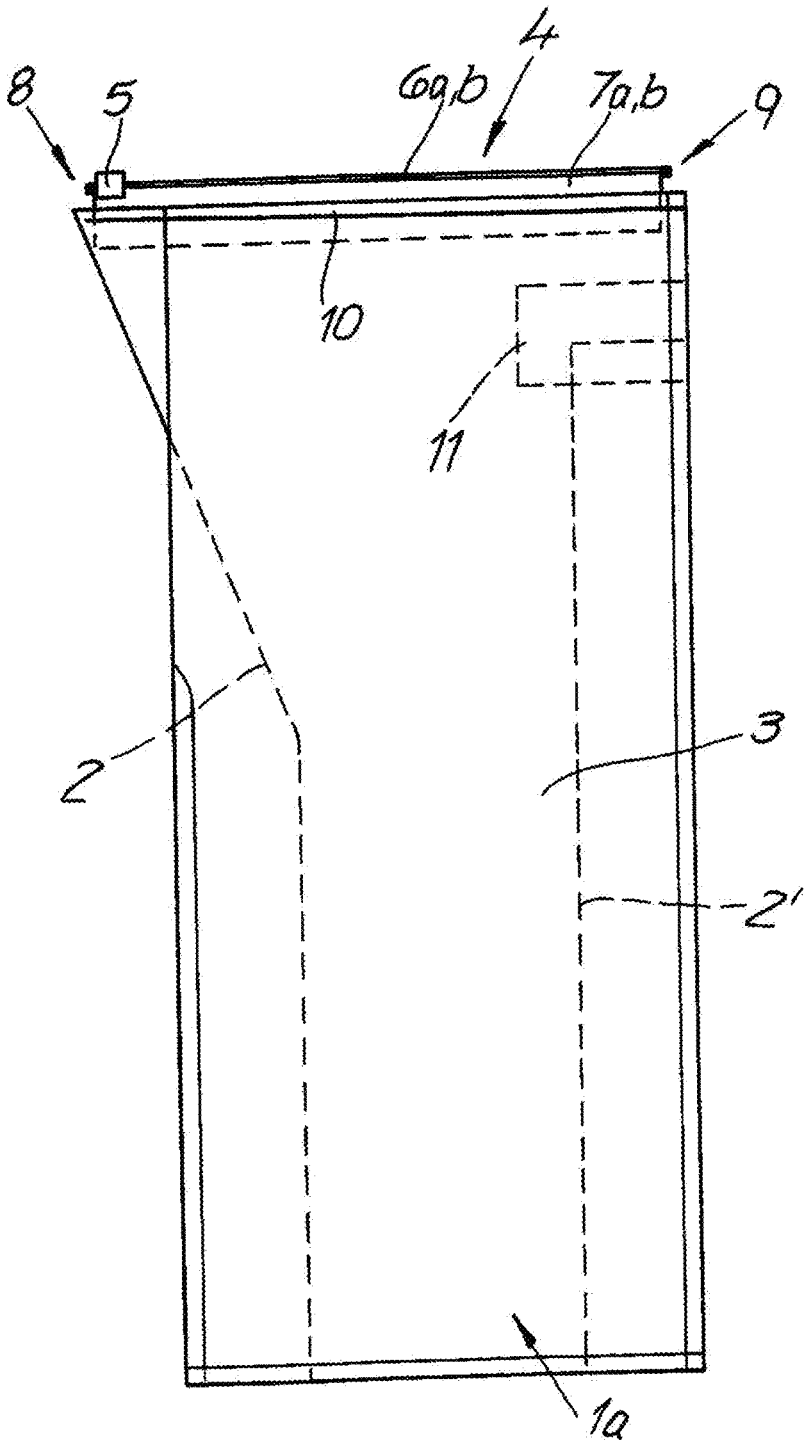

FIG. 7 shows a further embodiment of the side-gusset bag according to the invention, the inextensible gusset 2' being offset and covered by a separate film sheet 11. Contrary to the embodiments described above the first end 8 of the slide fastener 4 is arranged at a gusset 2 forming a spout such that the gusset 2 is fixed by the slide fastener 4 in the extended position. This is achieved in that the slide fastener 4 extends at its attachment flaps tabs 7*a* and 7*b* beyond the face panels 1*a* and 1*b* into a gusset 2 forming a spout. The second end 9 of the slide fastener 4 may be arranged, for example, at the center of the face panels, or as illustrated in the illustrated embodiment, at the opposite side above the offset gusset 2'. The length of the slide fastener 4 is longer than the width of the face panels 1*a* and 1*b* in the embodiment illustrated in FIG. 7. Based on an embodiment of FIG. 7 the slide fastener 4 does not extend directly into the point of the gusset 2 so this point may then be folded-in and covered at the top by the slide fastener 4

We claim:

1. A bag comprising:

two juxtaposed face panels of plastic film and each having two generally parallel side edges and top and bottom edges bridging the side edges;

a first gusset extending between one of the side edges of one of the panels and the juxtaposed side edge of the other of the panels, the first gusset being movable between a folded-in condition lying mainly between the panels and an extended condition projecting laterally past the panels and forming a spout generally at the top edges;

a slide fastener at the top edges and having two profile strips that can be locked to each other and that each have an attachment flap, and a slider shiftable along the profile strips in a closing direction to close the strips together and in an opposite opening direction to separate the strips;

joints securing the attachment flaps directly only to inner faces of the respective face panels at the respective top edges;

a second inextensible gusset extending between the other side edges of the face panels opposite the first gusset and ending at a spacing from the top edges;

a separate film sheet covering an upper end of the second inextensible gusset inside the bag; and a weld at an upper end of the inextensible second gusset and extending from the respective side edges diagonally toward the top edges, the top edges of the face panels connecting the face panels to the second inextensible gusset or connecting the face panels to each other.

2. The bag defined in claim 1 wherein the top edges are cut off above the inextensible gusset.

3. The foil packaging bag defined in claim 1, further comprising:

an air-tight tamper-indicating closure outward of a bag mouth formed at the top edges.

4. A bag comprising:

two juxtaposed face panels of plastic film and each having two generally parallel side edges and top and bottom edges bridging the side edges;

a first gusset extending between one of the side edges of one of the panels and the juxtaposed side edge of the other of the panels, the first gusset being movable between a folded-in condition lying mainly between the panels and an extended condition projecting laterally past the panels and forming a spout generally at the top edges;

a slide fastener at the top edges and having two profile strips that can be locked to each other and that each have an attachment flap, and a slider shiftable along the profile strips in a closing direction to close the strips together and in an opposite opening direction to separate the strips;

joints securing the attachment flaps directly only to inner faces of the respective face panels at the respective top edges;

a second inextensible gusset extending between the other side edges of the face panels opposite the first gusset and ending at a spacing from the top edges, the side edges being formed above the inextensible second gusset with a hand hole; and a separate film sheet covering an upper end of the second inextensible gusset inside the bag.

5. A bag comprising:

two juxtaposed face panels of plastic film and each having two generally parallel side edges and top and bottom edges bridging the side edges;

a first gusset extending between one of the side edges of one of the panels and the juxtaposed side edge of the other of the panels, the first gusset being movable between a folded-in condition lying mainly between the panels and an extended condition projecting laterally past the panels and forming a spout generally at the top edges;

a slide fastener at the top edges and having two profile strips that can be locked to each other and that each have an attachment flap, and a slider shiftable along the profile strips in a closing direction to close the strips together and in an opposite opening direction to separate the strips, the slide fastener extending only across part of the width of the face panels at the top edges;

joints securing the attachment flaps directly only to inner faces of the respective face panels at the respective top edges;

a second inextensible gusset extending between the other side edges of the face panels opposite the first gusset and ending at a spacing from the top edges; and a separate film sheet covering an upper end of the second inextensible gusset inside the bag.

6. A bag comprising:

two juxtaposed face panels of plastic film and each having two generally parallel side edges and top and bottom edges bridging the side edges;

a gusset extending between one of the side edges of one of the panels and the juxtaposed side edge of the other of the panels;

a slide fastener at the top edges and having two profile strips that can be locked to each other and that each have an attachment flap, and a slider shiftable along the profile strips in a closing direction to close the strips together and in an opposite opening direction to separate the strips, an upper end of the gusset being permanently folded out from between the face panels and the strips extending past the side edges at the gusset along respective outer faces of the gusset; and joints securing the attachment flaps directly only to inner faces of the respective face panels at the respective top edges.

7. A foil packaging bag comprising:

two opposite front walls formed from a bag foil, a side gusset extending from a head section of the foil packaging bag over at least one partial section of one side of the bag where it connects the opposite front walls with each other, and a reclosable fastener disposed in the head section and extending transversely, said reclosable fastener comprising a slider, two mutually lockable profile strips straddled in a rider-like manner by the slider and mounted above top edges of the front walls, and fastening tabs connected thereto by means of which the reclosable fastener is connected to the bag foil on the inside of the bag, movement of the slider limited by the first end of the reclosable fastener along the profile strips in a first direction connecting the profile strips, an opposite movement limited by a second end of the reclosable fastener in a second direction separating the profile strips, the side gusset when the reclosable fastener is opened forming a spout in its folded-out state, when the reclosable fastener is closed, the side gusset at its upper spout-forming end being covered by the connected profile strips thereabove, the reclosable fastener extending in the area of the first end beyond the front walls and being arranged and fixed at the spout-forming side gusset in such a way that the spout-forming side gusset is permanently fixed by the reclosable fastener in a folded-out state, at the second end of the reclosable fastener the fastening tabs being directly supported against the front walls and connected with the front walls in such a way that one connecting lug is attached to one of the front walls and the other connecting lug is attached to the other front wall.

* * * * *